United States Patent [19]

Stewart

[11] 4,267,973

[45] May 19, 1981

[54] PARKING LOT AND HIGHWAY SAFETY LINE PAINTING MACHINE

[76] Inventor: James J. Stewart, 3817 Capers Ave., Columbia, S.C. 29205

[21] Appl. No.: 872,772

[22] Filed: Jan. 27, 1978

[51] Int. Cl.[3] ..... B05C 5/00

[52] U.S. Cl. ..... 239/73; 118/305; 239/143; 239/150; 239/172; 239/176

[58] Field of Search ..... 118/305, 612; 239/150, 239/73, 148, 172, 151, 143, 176, 165; 427/137, 138

[56] References Cited

U.S. PATENT DOCUMENTS

| | | | |
|---|---|---|---|
| 1,550,685 | 8/1925 | Eynon et al. | 118/612 X |
| 2,076,370 | 4/1937 | Hollingshead | 118/305 X |
| 2,221,908 | 11/1940 | Bossi | 118/305 X |
| 2,304,726 | 12/1942 | Beaman | 239/150 X |
| 2,317,288 | 4/1943 | McCubbin | 239/150 |
| 3,373,938 | 3/1968 | Sweet | 239/150 X |

*Primary Examiner*—John P. McIntosh
*Attorney, Agent, or Firm*—Penrose Lucas Albright

[57] ABSTRACT

Line painting equipment mounted on a small tractor with an air compressor mounted on the front of the tractor and a paint containing tank mounted on its rear portion. A further elongated pressurized paint container is mounted on one side of the tractor and inclined downwardly towards the front of same. A boom is clamped to the tractor forward of the pressurized paint container which is also normally inclined downwardly towards the front of the tractor. The boom is so secured to the tractor that it can be selectively rotated on its longitudinal axis, moved outwardly on a substantially vertical axis and moved vertically about a substantially horizontal axis. A paint spray gun is removably mounted on the front of the boom as is an adjustable boom support wheel which governs the height of the paint spray gun over the underlying surface. An adjustable guide to indicate to the operator where the paint is sprayed is mounted from the steering linkage of the tractor. One line from the air compressor is utilized to pressurize the elongated paint container and the other line leads to the spray paint gun. Paint is fed from the bottom of the elongated pressurized paint container to the paint gun. A further line connects the compressor air to the elongated container for bubbling air through same as a means of agitating the paint therein. A still further line with a valve therein provides paint from the paint tank on the back of the tractor to the elongated paint container. An air line to actuate the paint gun is a foot-controlled air valve. Exhaust from the internal combustion engine of the tractor is carried through an exhaust pipe to blow exhaust towards the surface area immediately ahead of that which is to be painted for clearing debris and the like therefrom. The paint gun is removable from its support on the boom and can be held by hand or otherwise stored in a paint solvent containing cap on the tractor. A limit bar extends from the tractor for limiting the downward movement of the boom whereby the paint spray gun cannot accidently be dislodged to fall on the underlying surface during the painting operation.

13 Claims, 4 Drawing Figures

Fig. 1
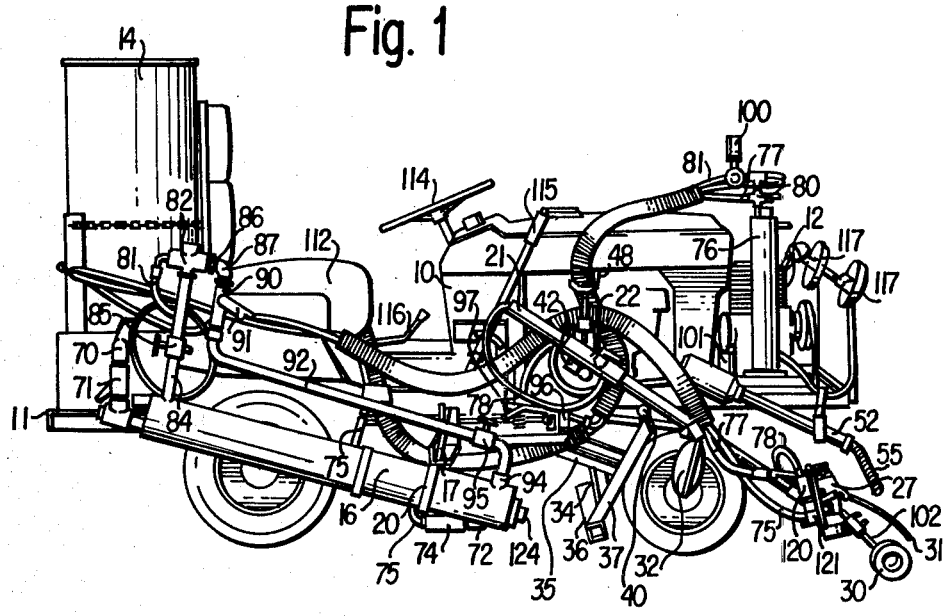
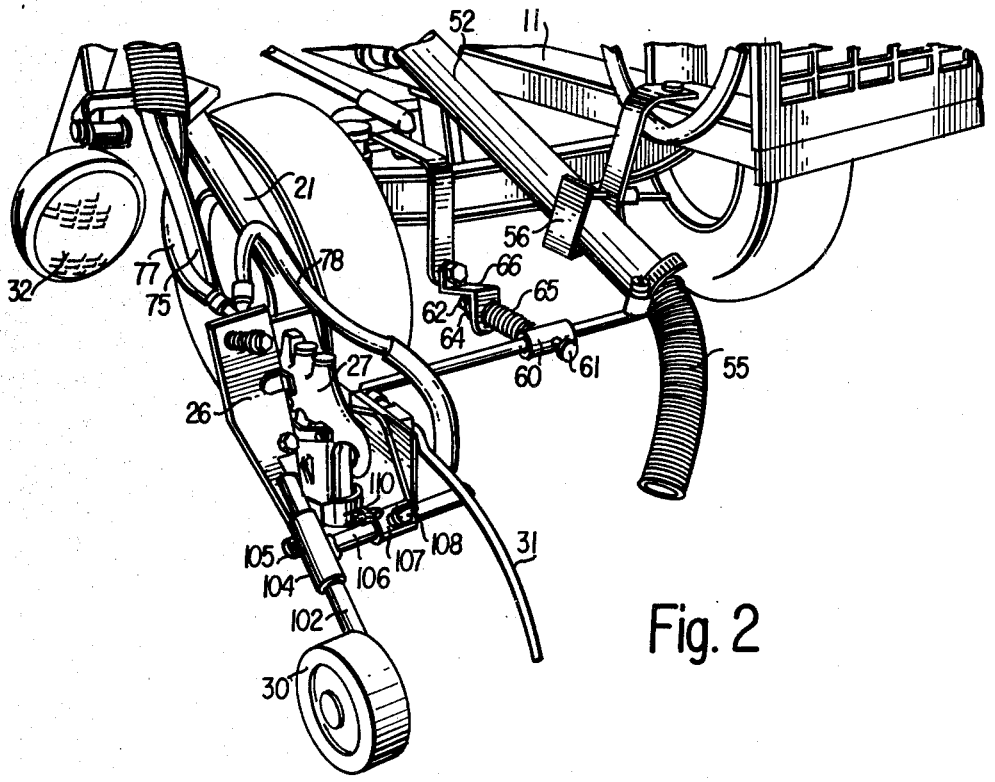
Fig. 2

PARKING LOT AND HIGHWAY SAFETY LINE PAINTING MACHINE

BACKGROUND OF THE INVENTION

The invention relates to equipment for painting lines on an outdoor surface and, in particular, to such equipment which may have as its chief function the painting of demarkation lines in parking lots and the like.

The painting of lines to indicate parking spaces in parking lots and the like is generally a labor-intensive job requiring the cooperative labor of four or five men since it must often be accomplished in a relatively short period of time. Such lines may be painted by hand or a manually manipulated cart may be utilized. Large equipment such as used for painting the center lines on a highway is generally too awkward for tasks other than that for which it has been specially designed. Thus, a need exists and has existed for some time for a relatively compact self-propelled mobile unit which can paint lines in a parking lot or the like accurately and rapidly.

In considering the prior art, attention is invited in particular to a patent of Sweet, U.S. Pat. No. 3,373,938 of Mar. 19, 1968, which discloses a line-marking vehicle having a boom mounted spray paint nozzle capable of painting lines on both horizontal and vertical surfaces. In such device, the painting assembly is carried by a relatively small hand truck and the boom supporting the spray nozzle is mounted on the truck for both vertical and lateral adjustment relative thereto. Rotation of handles produces vertical and lateral adjustments about a pivotal sleeve. A patent to Harding et al, U.S. Pat. No. 3,477,352 of Nov. 11, 1969, discloses the use of a wheel to support the forward end of a boom upon which is mounted a spray gun. The rear end of the boom is pivotally connected to a vehicle chassis so that the boom can be swung up to its storage position. A further highly portable road marking device in the prior art is illustrated in the patent to Glasgow, U.S. Pat. No. 1,999,563 of Apr. 30, 1935. This patent teaches a spray gun mounting bracket wherein the gun can be readily released from its mounting for cleaning and other use. Other devices of general interest are disclosed in the patents to Schroth, U.S. Pat. No. 2,074,623 of Mar. 23, 1937, to Hollingshead, U.S. Pat. No. 2,076,370 of Apr. 6, 1937, to Gardner, U.S. Pat. No. 2,812,211 of Nov. 5, 1957, and to Wilson, U.S. Pat. No. 3,046,854 of July 31, 1962.

SUMMARY OF THE INVENTION

The equipment utilized for line painting in accordance with the instant invention is mounted on a garden-type Ford tractor, Model 75. However, it will be appreciated by those skilled in the art that any comparable vehicle will suffice. An important aspect of the invention is the availability of a speed from one to ten miles per hour with a speed of five to seven miles per hour being normal in the painting operation. As a result, the equipment is considerably more productive than manually operated equipment utilized for a similar purpose.

In the invention, a large, up to ten gallon, tank of paint is carried on the rear of the tractor. The compressor to supply compressed air for painting operation is mounted on the forward portion of the tractor whereby the weight of these components is balanced relative to the tractor. A pressurized container for a significant amount of paint is mounted on the side of the tractor and at an angle. Air pressure is applied to the upper and rearward portion of the container and whereby paint under pressure flows from the forward lower part thereof. This insures effective use of the paint without requiring an overly large paint container and also insures that paint in the container may be completely used without leaving a pool of paint. The container has pressurized air not only connected to its rearward portion but also connected (or connectable) to its lower part forwardly whereby air can be released from the rear portion of the container and air from the forward part is caused to bubble through the paint thereby agitating same. It has been found in practice that so agitating the paint about every twenty-four hours is sufficient to keep it in a proper homogeneous condition. The boom is attached to the side of the tractor and can be raised or lowered or moved to the side in an arcuate motion. Also, the boom can be turned about on its own longitudinal axis to paint curves and guard rails. In practice, the tractor can be backed up to a curb to paint a line on either side of an automobile without moving the automobile if as little as a five inch clearance from the automobile is provided. A spray gun holder is provided on the tractor for holding the spray gun when not in use, a solvent such as kerosene or the like being provided in the holder so that the nozzle does not have to be cleaned after every use. The preferred spray gun is manufactured by Benks and, in operation, is releasably held near the lower end of the boom which has a wheel attached thereto that bears on the underlying surface to ensure that the spray gun is maintained at the same distance from the surface even though the latter may be contoured. A pedal is provided on the frame of the tractor which starts and stops air to the nozzle to control the flow of paint from the paint gun. It has been found useful to provide a guide arm attached to the tractor's steering linkage for the line-of-sight painting of straight and curved lines. An exhaust pipe from the internal combustion engine of the tractor is located and pointed to blow debris from in front of the surface to be painted.

It has been found in practice that the unit as designed may be utilized not only for outside work but also for inside spray painting such as for safety lines inside of the factory. It is also sufficiently maneuverable so that letters, arrows and the like may be painted. Overspray does not result. If desired, by raising the boom, a much broader spray area can be provided for painting decks, walkways, and the like. Inasmuch as frequently parking lots and the like must be painted during the night, lights are mounted on the tractor and boom for night operations.

Apparatus in accordance with the invention permits the painting of a parking lot by two men, one marking the lines and the other operating the painting equipment often in a lesser amount of time than accomplished by prior art devices requiring four or five men. In the event that old lines are to be repainted, the operation can be performed by an individual operator. Thus, it is to be understood that an important aspect of the invention is that it operates more efficiently and effectively and, at the same time, has eliminated or substantially reduced routine maintenance operations.

Other objects, adaptabilities, and capabilities of the invention will be understood by those skilled in the art from the following description and disclosure, reference being had to the accompanying drawings; into which:

BRIEF DESCRIPTION OF THE DRAWINGS

FIG. 1 is a side elevational view of the invention;

FIG. 2 is a detailed view of the forward portion of the boom with the spray paint gun and associated equipment mounted thereon;

FIG. 3 is a detailed view similar to FIG. 2 showing the boom turned for the function of painting curbs and the like; and FIG. 4 is a perspective rear view which illustrates a boom extending laterally for the purpose of painting guard rails or the like.

DESCRIPTION OF THE PREFERRED EMBODIMENTS

Figure 3:
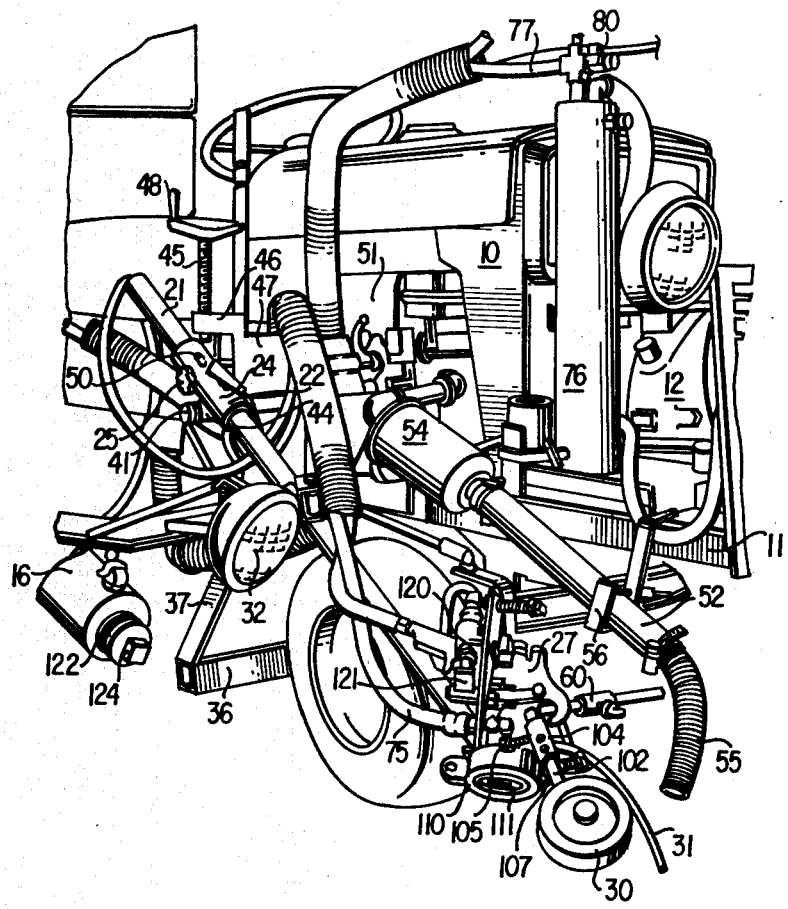

Referring to the drawings, a tractor 10, which includes a frame 11, has mounted on its forward end an air compressor 12 and on its rear portion a twelve-gallon paint tank 14. An extension 15 supports the rear portion of a pressurized paint tank 16 which is inclined downwardly towards the front of the tank wherein it is supported by a further frame extension 17 and a surrounding strap 20. A boom 21 comprising a hollow tube is supported by a boom clamp 22 which is mounted on frame 11 and includes an elongated collar 24 which slidably receives boom 21 which can be fixed relative to collar 24 by turning a handle 25 which is operatively connected to a set screw threadably received in collar 24 selectively to bear against boom 21 contained therein. Mounted on the lower forward end of boom 21 is a paint spray gun mounting 26 which removably supports an air paint spray gun 27 and also an adjustable ground-engaging wheel 30. A forward paint indicator guide 31 is mounted from the steering linkage of the two front wheels of tractor 10. A lamp 32 is also mounted in the front end of boom 21 somewhat to the rear of the mounting 26 so as to illuminate the surface area whereon the paint is to be sprayed from paint spray gun 27. A pair of struts 34 depend vertically from wheel braces 35 of frame 11, struts 34 having welded thereto a horizontal bar 36 from which, to the right side of the tractor as seen in FIG. 1, a forwardly and upwardly extending angle bar 37 is secured. Angle bar 37 has a limit bar 40 welded to its upper aspect to extending horizontally and inwardly, the function of bar 40 being to limit downward movement of boom 21 whereby paint spray gun 27 is prevented from contacting the ground even if wheel 30 should be loosely connected in the mounting 26. A stud 41 extends normally from frame 11 to which it is rigidly attached relative to the longitudinal axis of the tractor 10. Stud 41 has a sleeve 44 rotatably carried thereon. A pivot mounting 42 receives a short pivotal axel which is welded to the underside of collar 24 whereby the boom 21 may be moved about the substantially vertical axis of pivot mounting 42 in a generally horizontal arcuate manner.

At the same time, pivot mounting 42 being rotatably attached to stud 41 via a sleeve 44, boom 21 is enabled to move above limit bar 40 in vertical arcuate motion, stud 41 providing the axis for such vertical arcuate motion.

Figure 4:
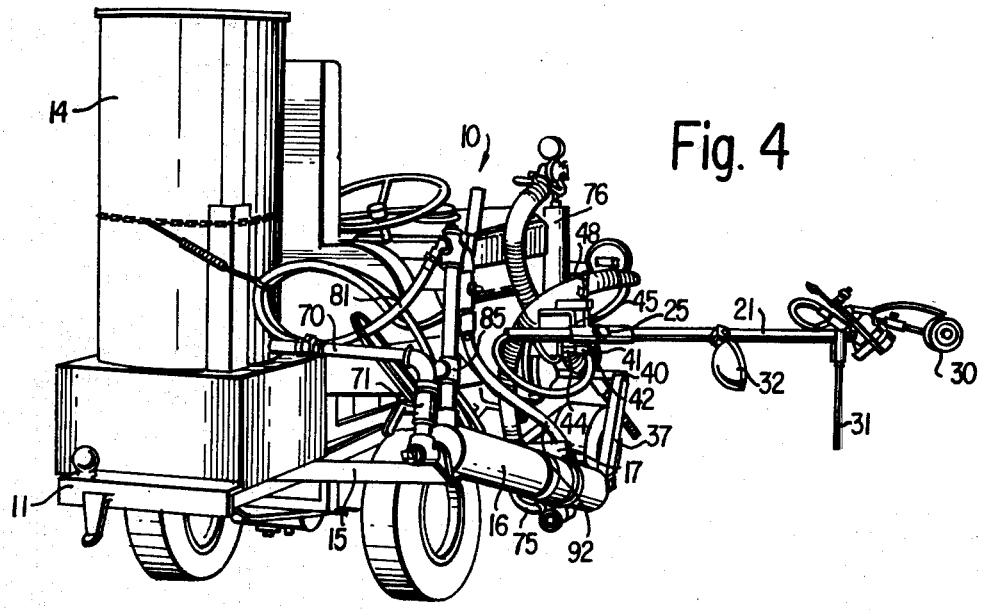

Boom clamp 22 includes a crank 48 with a threaded spindle 45 which is threadably received in an opening of arm 46 welded to a lateral extension 47 of frame 11. A depression 50 axially aligned with mounting 42 in collar 24 receives the matching underside of spindle 45 for turning collar counter-clockwise as seen in FIG. 1 and contributing to its support in the outward position shown in FIG. 4.

The internal combustion engine 51 of tractor 10 has an exhaust pipe 52 which includes a muffler 54 and an adjustable terminal end 55, pipe 52 being supported by a bracket 56 welded to frame 11 and end 55 being adjusted so that the exhaust from engine 51 is directed in front of the area to be painted by paint spray gun 27 to remove debris and the like from such area.

Guide rod 31 is mounted on a sleeve 60 by means of a set screw 61 which has rigidly attached thereto a rod 62 which receives a nut 64 on its rearward threaded end and is surrounded by a compression spring 65, one end of the compression spring urging sleeve 60 outwardly and the other end of the compression spring pressing against the bracket 66 which is removably secured to the right hand steering arm of the steering mechanism of tractor 10.

By lining up guide rod 31 with the left margin of the line to be painted, the line produced by paint gun 27 is located as desired and largely avoids irregularities. Further, movement of the steering arm whereby bracket 66 is correspondingly moved permits the use of rod 31 as a guide for accurately painting curved lines.

The outlet of tank 14 is connected to the inlet of tank 16 by means of a conduit 70 containing a valve 71. The outlet 72 of tank 16 is located forwardly and connects to a paint strainer 74 which in turn receives paint tubing 75 which conveys paint to paint gun 27.

Compressed air tank 76 receives air from air compressor 12 and delivers compressed air through a hose 77 to paint gun 27 via a regulating valve 80 which maintains the desired pressure of air to the gun 27 and which, furthermore, delivers air to a further hose 81 which functions as an air passage conduit to a tee 82. Pipe 84 connects the top of tank 16 with tee 82. Pipe 84 contains a three-way valve 85 which can open or close the passage through pipe 84 or provide a vent for tank 16. From the forward part of tee 82, a nipple 86 connects to an elbow 87 which, in turn, connects to a pipe 90 containing a valve 91. The lower portion of pipe 90 receives a hose 92 which connects to the lower part of the tank 16 through an air inlet connection 94, the hose 92 being provided with a valve 95.

Air hose 77 to paint gun 27 passes through an air valve 96 which is controlled by a boot pedal 97 mounted on tractor 10. The air pressure at hose 81 is displayed on a gauge 100 which can be readily observed by the operator of tractor 10.

When not in use, the spray gun 27 is placed in a spray gun holder 101 which contains kerosene or the like to prevent the paint from hardening in the nozzle when not in use.

It will be seen in FIGS. 2 and 3 that the boom support wheel 30 is supported by a shaft 102 which is received in a collar 104 having a set screw 105, collar 104 being welded to a rod 106 which is received in a further collar 107 with a further set screw 108, collar 107 being welded to a cup 110 which is part of and rigidly connected to mounting 26, cup 110 receiving the forward nozzle portion 111 of paint gun 27. Tractor 10 includes a seat 112, a steering control wheel 114, a hand brake 115, an accelerator pedal 116, and a pair of forward lights 117 mounted at the front of the tractor. Compressor 12 can be powered from a power take-off of tractor 10 or it may be powered independently of tractor 10 by its own engine, as desired.

A bellows 120 actuates, via lever 121, the trigger of air gun 27, bellows 120 being, in turn, actuated by the admission of air under pressure through hose 78 which connects to hose 77 after air valve 96. By pressing on foot pedal 97 and thus opening air valve 96 air is supplied under pressure both to the trigger of air gun 27 and to its air spray via hose 77.

Paint pressure is maintained at sixty to seventy pounds per square inch by pressure from hose 81 via tee 82 and pipe 84 which connects to the top of the tank 16. Air for paint spray gun 27 is maintained at about eighty pounds per square inch from tank 76 through hose 77 with air valve 96 in an open condition. If desired pedal 97 may also operate a shut-off valve in paint line 75.

In operation, the operator first insures that tank 16 is filled by opening valve 71, valve 85 being opened to vent tank 16 only, valves 91 and 95 are open whereby with compressor 12 in operation, air bubbles travel through the tank 16 and are vented by valve 85. Such agitation, if provided for approximately five minutes every twenty-four hours, is sufficient to keep the paint in a usable condition without draining tank 16. Following this operation, valves 91, 95 and 71 are closed and valve 85 is placed to open pipe 84 and close the vent for tank 16 whereby pressure is placed on tank 16 of about sixty to seventy psi, such pressure being registered by gauge 100.

Paint gun 27, which is stored, when not in operation, in container 101 is placed in mounting 26 with its nozzle 111 in cup 110. The positions of wheel 30, guide rod 31, conduit 55 and boom 21 are then adjusted for the particular job to be accomplished. In the event that lines are to be painted as for a parking lot, then the adjustment made is as shown in FIGS. 1 and 2. However, if curbs are to be painted, then the various components are adjusted to the condition shown in FIG. 3. For the painting of guard rails and the like, boom 22 is extended normally from the longitudinal axis of the tractor to the position shown in FIG. 4. The lines to be painted, as in a parking lot, are first appropriately marked and then the operator driving tractor 10 by watching rod 31 and keeping same on the line commences the painting operation by actuation of air valve 96 by pedal 97. The lines can then be painted by one individual driving the tractor and, as previously indicated, as a skilled operator generally maintains a velocity in the painting operation of five to seven miles per hour.

In the event that tank 16 empties, it can be easily refilled by placing valve 85 in the vent position for tank 16 and opening valve 70 whereby initially pressure within tank 16 is relieved. When the pressure in tank 16 equalizes with atmospheric pressure, paint enters conduit 70 from tank 14 into tank 16. In the event that the paint is highly viscous or, if otherwise desired, hose 92 can be disconnected from pipe 90 to provide a further vent for tank 16.

Strainer 74 at the base of tank 16 prevents the spray nozzle 111 and the paint lines from clogging. Such strainer is of a type whereby it can be easily be cleaned without draining tank 16. It will be also noted that tank 16 is provided with an opening 122 which is closed by a plug 124, such plug being thus removable for cleaning tank 16 when desired or necessary.

The center of gravity of the air compressor 12 and the ten gallon paint tank 14 are each disposed to the left side of the longitudinal centerline of tractor 10 to counterbalance, at least in part, the weight of the tank 16, boom 21 and other apparatus disposed on the right side of the longitudinal centerline of tractor 10.

Although the preferred embodiment of the invention has been described, it is to be understood that the invention is capable of other adaptations and modifications within the scope of the appended claims and it is therefore intended that various components of the invention set forth in the following claims be construed to cover not only the corresponding structure described in the specification but also equivalents thereof.

Having thus described my invention, what I claim as new and desire to secure by Letters Patent of the United States is:

1. An implement for painting lines on the surface of highways, parking lots and the like which comprises:

a vehicle including a motor for propelling same, at least one steerable front ground engaging wheel and a frame;

an air compressor mounted on said frame in the forward portion of said vehicle;

a tank for paint mounted on the rearward portion of said vehicle;

an elongated pressurized paint container mounted on one side of said frame whereby it is inclined downwardly towards the front of said vehicle;

swivel clamp means mounted on said frame forward of said container;

boom means held by said clamp means whereby it extends downwardly towards the front of said vehicle, said boom means being selectively turnable about its longitudinal axis and selectively extensible along its longitudinal axis relative to said clamp means, said clamp means being selectively movable within an arc of movement as seen from the side and further within an arc of movement as seen from above;

an air spray paint gun mounted at the forward end of said boom means;

a first air conduit provided between said compressor and said paint container for applying air pressure to the latter;

a second air conduit connecting said compressor to said paint spray gun;

a third air conduit connecting said compressor to the forward end of said container;

a first paint conduit from said paint tank to said container;

a second paint conduit connecting said container to said paint spray gun;

control valve means in said second air conduit for selectively actuating opening and closing said second air and paint conduits whereby paint and air under pressure are selectively received by said paint gun, and further valve means in said third air conduit for selectively providing air for agitating paint contained in said container; and guide means interconnected to said steerable wheel, said guide means adapted to be pointed at area on said surface towards which said paint spray gun is directed when supported by said boom means, whereby said paint spray gun is adapted to move in the direction to be travelled by said vehicle and to indicate where said paint spray gun will paint on said surface.

2. An implement in accordance with claim 1, wherein said motor is an internal combustion engine and the exhaust therefrom is directed to the surface to be painted immediately ahead of the specific area on said surface towards which said paint gun is directed when supported by said boom means.

3. An implement in accordance with claim 1, wherein a lamp is supported by said boom, said lamp adapted to illuminate the area on said surface towards which said paint gun is directed when supported by said boom means.

4. An implement in accordance with claim 1, wherein limit bar means is supported by said frame which is adapted to limit the downward motion of said boom whereby said paint gun is prevented from contacting said surface.

5. An implement in accordance with claim 1, wherein adjustable ground engaging means is provided at the lower end of said boom, said ground engaging means adapted to retain said paint gun at the end of said boom at a uniform distance over the underlying surface being painted.

6. An implement in accordance with claim 1 wherein a valve is provided in said first air conduit which is a three-way valve which is adapted to vent the space in said container above said paint when air from said third conduit agitates paint contained therein, said third air conduit connected to the lower portion of said container.

7. An implement in accordance of claim 1 wherein said paint gun is removably carried by paint gun carrying means mounted in said boom, the nozzle of said paint gun being supported by said carrying means a selected distance above the underlying surface as determined by the position of an adjustable support wheel also mounted on said boom at its forward end.

8. An implement in accordance with claim 1 wherein the center of gravity of said air compressor and the center of gravity of said tank for paint are each located on the opposite side of the longitudinal centerline of said vehicle from said boom means.

9. An implement in accordance with claim 8 wherein said elongated pressurized paint container is located on the same side of the longitudinal centerline of said vehicle as said boom means.

10. An implement for painting lines on highways, parking lots and the like which comprises:

a tractor including a frame;

an air compressor mounted on said frame;

an elongated pressurized paint container mounted on said frame whereby it is inclined downwardly;

a paint tank carried by said frame;

movable boom means mounted on said frame, said boom means being selectively turnable about its longitudinal axis and also about a substantially vertical axis and a substantially horizontal axis;

an air spray paint gun mounted at the outer end of said boom means;

a first air conduit provided between said compressor and said paint container for applying air pressure to the latter;

a second air conduit connecting said compressor to said paint spray gun;

a third air conduit connecting said compressor proximate to the lowermost end of said container whereby air under pressure is admitted from said third air conduit in a downward direction into said container;

a first paint conduit from said paint tank to said container;

a second paint conduit connecting said container to said paint spray gun;

control valve means in said second air conduit for selectively opening and closing said second air and paint conduits whereby paint and air under pressure are selectively received by said paint gun, and further valve means in said third air conduit for selectively providing air through said third air conduit into its said lowermost end connection into said container for agitating paint contained in said container.

11. An implement in accordance with claim 10 wherein said container is cylindrical in shape and is disposed on one side of said tractor.

12. An implement in accordance with claim 11 wherein the lower end of said container is its forward end relative to the normal direction of forward movement by said tractor.

13. An implement in accordance with claim 10 wherein said third air conduit connects said container at a location higher than the location wherein said second paint conduit connects said container.

* * * * *